US009617749B1

(12) United States Patent
Peng et al.

(10) Patent No.: US 9,617,749 B1
(45) Date of Patent: Apr. 11, 2017

(54) CHAIN TYPE VEHICLE CONVEYING DEVICE FOR STEREO GARAGE

(71) Applicant: Hunan Sanjie Intelligent Parking Co., LTD, Changsha (CN)

(72) Inventors: Nanhua Peng, Changsha (CN); Shizhong Yin, Changsha (CN)

(73) Assignee: Hunan Sanjie Intelligent Parking Co., LTD, Changsha (CN)

( * ) Notice: Subject to any disclaimer, the term of this patent is extended or adjusted under 35 U.S.C. 154(b) by 0 days.

(21) Appl. No.: 14/990,823

(22) Filed: Jan. 8, 2016

(30) Foreign Application Priority Data

Oct. 20, 2015 (CN) ..... 2015 1 0677877

(51) Int. Cl.

| | |
|---|---|
| ***B65G 15/10*** | (2006.01) |
| ***B65G 15/22*** | (2006.01) |
| ***B65G 15/24*** | (2006.01) |
| ***E04H 6/32*** | (2006.01) |

(52) U.S. Cl.
CPC ..... *E04H 6/32* (2013.01)

(58) Field of Classification Search
CPC ..... B65G 15/10; B65G 15/22; B65G 15/24
USPC ..... 198/465.3, 575, 604, 626.1, 725, 726, 198/728, 730, 817, 834, 841; 104/172.1
See application file for complete search history.

(56) References Cited

U.S. PATENT DOCUMENTS

| | | | | | |
|---|---|---|---|---|---|
| 3,274,659 | A * | 9/1966 | Baker | B28B 3/022 | 198/599 |
| 4,194,449 | A * | 3/1980 | Breau | B60S 3/004 | 104/162 |
| 4,941,563 | A * | 7/1990 | Fahrion | B65G 17/002 | 198/465.3 |
| 5,238,101 | A * | 8/1993 | Ota | B65G 17/26 | 198/626.5 |
| 7,293,640 | B1 * | 11/2007 | Aulick | B60P 1/38 | 198/817 |
| 7,637,367 | B1 * | 12/2009 | Cannell | B65G 17/002 | 198/465.3 |
| 7,752,828 | B2 * | 7/2010 | Gudim | B65B 5/068 | 198/803.11 |
| 8,047,756 | B2 * | 11/2011 | Tuffs | B60L 15/38 | 198/463.3 |
| 8,322,509 | B2 * | 12/2012 | Yokoo | B65G 17/46 | 198/339.1 |

(Continued)

*Primary Examiner* — Douglas Hess
(74) *Attorney, Agent, or Firm* — Depeng Bi; Law Offices of Konrad Sherinian

(57) ABSTRACT

A chain type vehicle conveying device is used in stereo garages. The vehicle conveying device includes two conveyor assemblies moving in synchronous circulating motion. Each conveyor assembly includes two parallel chains with attached plates. Parallel crossbeams are affixed to the two chains of each conveyor assembly to support a vehicle. The chains with attached plates each include an upper portion and a lower portion at any point during a moving cycle of the chains. The upper portion slides on a corresponding sliding rail mounted to a frame. The lower portion slides on a corresponding sliding pallet matching the crossbeams and mounted to the frame. Each conveyor assembly is moved by a pair of driving sprockets meshing with the two chains of the conveyor assembly and a pair of tension pulleys. A power transmission gear of the vehicle conveying device transmits power to the driving sprockets.

5 Claims, 4 Drawing Sheets

(56) References Cited

U.S. PATENT DOCUMENTS 8,376,130 B2 * 2/2013 Deyanov ..... B65G 15/105
198/817
8,727,100 B2 * 5/2014 Ecob ..... B65G 21/2072
198/415

* cited by examiner

CHAIN TYPE VEHICLE CONVEYING DEVICE FOR STEREO GARAGE

CROSS REFERENCE TO RELATED APPLICATIONS

This application claims the benefit and priority of China Patent Application Number 201510677877.9, entitled "CHAIN TYPE VEHICLE CONVEYING DEVICE FOR STEREO GARAGE," filed Oct. 20, 2015 and which is hereby incorporated by reference in its entirety.

FIELD OF THE DISCLOSURE

The present invention generally relates to a vehicle conveying apparatus, and more particularly relates to a vehicle conveying device for a stereo garage. More particularly still, the present disclosure relates to a chain type vehicle conveying device for a stereo garage.

DESCRIPTION OF BACKGROUND

Conventional vehicle conveying devices used in stereo garages utilize self-propelled carriers or vehicle carrying plates to transport vehicles between listing and transferring devices and parking lots. During the transportation, the self-propelled carriers or vehicle carrying plates need to move back and forth between the listing and transferring devices and the parking lots of the vehicles. The transportation process includes lifting, gripping vehicle tires and other steps. The entire parking process involves too many steps and actions along with some auxiliary redundant actions. Accordingly, present vehicle conveying devices result in longer vehicle parking and retrieving time. Stereo garages deploying conventional vehicle conveying devices oftentimes cause traffic jam during peak of parking. Furthermore, conventional vehicle conveying devices for stereo garages incorporate complex structures and result in high failure rate. Accordingly, there is a need for a new vehicle conveying apparatus used in stereo garages to overcome the aforementioned shortcomings.

SUMMARY OF THE DISCLOSURE

Generally speaking, pursuant to the various embodiments, the present disclosure provides a chain type vehicle conveying device for a stereo garage. The chain type vehicle conveying device includes two synchronously circulating conveyor assemblies mounted to a frame. Each of the two conveyor assemblies includes two chains with attached plate and a set of crossbeams mounted to the two chains. Each chain includes an upper portion supporting a weight of a vehicle and a lower portion. The chain type vehicle conveying device further includes four sliding rails mounted to the frame. Each of the upper portions slides on a corresponding sliding rail of the four sliding rails. The chain type vehicle conveying device also includes four sliding pallets mounted to the frame. Each of the lower portions slides on a corresponding sliding pallet of the four sliding pallets. The chain type vehicle conveying device further includes four driving sprockets and four tension pulleys. The four driving sprockets are mounted to a transmission shaft. In addition, the four driving sprockets mesh with the respective chains.

The chain type vehicle conveying device for stereo garages embodies a simple structure without unnecessary moving equipment, performs actions with direct results, and avoids unnecessary steps. Through the friction between the crossbeams of the two conveyor assemblies and the tires of the vehicle, the chain type vehicle conveying device moves the vehicle into a garage, such as a stereo garage. The chain type vehicle conveying device greatly reduces the time to park the vehicle in the stereo garage and retrieve the vehicle from the stereo garage. In addition, the chain type vehicle conveying device reduces power consumption and increases parking efficiency.

BRIEF DESCRIPTION OF THE DRAWINGS

Although the characteristic features of this disclosure will be particularly pointed out in the claims, the invention itself, and the manner in which it may be made and used, may be better understood by referring to the following description taken in connection with the accompanying drawings forming a part hereof, wherein like reference numerals refer to like parts throughout the several views and in which:

A person of ordinary skills in the art will appreciate that elements of the figures above are illustrated for simplicity and clarity, and are not necessarily drawn to scale. The dimensions of some elements in the figures may have been exaggerated relative to other elements to help understanding of the present teachings. Furthermore, a particular order in which certain elements, parts, components, modules, steps, actions, events and/or processes are described or illustrated may not be actually required. A person of ordinary skills in the art will appreciate that, for the purpose of simplicity and clarity of illustration, some commonly known and well-understood elements that are useful and/or necessary in a commercially feasible embodiment may not be depicted in order to provide a clear view of various embodiments in accordance with the present teachings.

DETAILED DESCRIPTION

Figure 1:
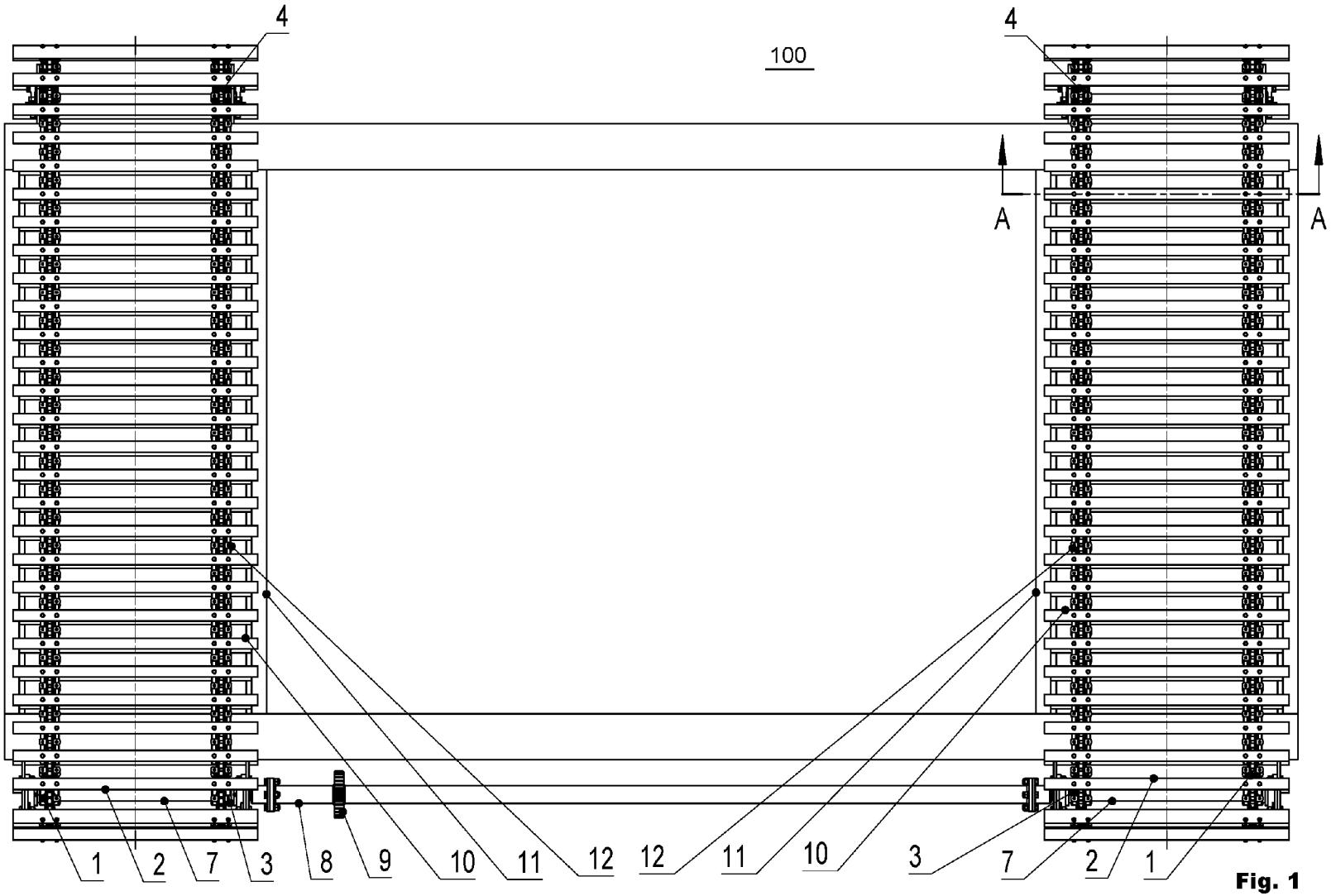
FIG. 1 is a schematic diagram of a chain type vehicle conveying device for a stereo garage in accordance with the teachings of this disclosure.

Turning to the Figures and to FIG. 1 in particular, a schematic diagram illustrating a chain type vehicle conveying device for stereo garages is shown and generally indicated at 100. The vehicle conveying device 100 includes a pair of synchronously circulating conveyor assemblies 10 mounted to a frame 11, and a transmission shaft 8 operatively coupled to the conveyor assemblies 10. The two conveyor assemblies 10 are parallel to each other and perpendicular to the shaft 8. Each conveyor assembly 10 includes two parallel chains 1 and a set of parallel crossbeams 2. The two chains 1 each includes an attached plate. The set of crossbeams 2 is operatively coupled to the two chains 1. In one implementation, the set of beams 2 is attached to the chains 1 using bolts, such as screw bolts or threaded bolts. The tires of a vehicle being transported by the device 100 rest on the beams 2. In one implementation, the spacing between any two consecutive parallel beams 2 is not more than, for example, one third of the width of a vehicle tire. Each of the chains 1 includes a plurality of plates 12. Each plate 12 includes an aperture while each cross beam 2 includes a set of apertures as well. When a crossbeam is attached to the chains 1, its apertures are aligned to the apertures of the corresponding plates 12. Fastening devices, such as screws, are then received by the aligned apertures and thus attach the beams 2 to the chains 1.

Figure 2:
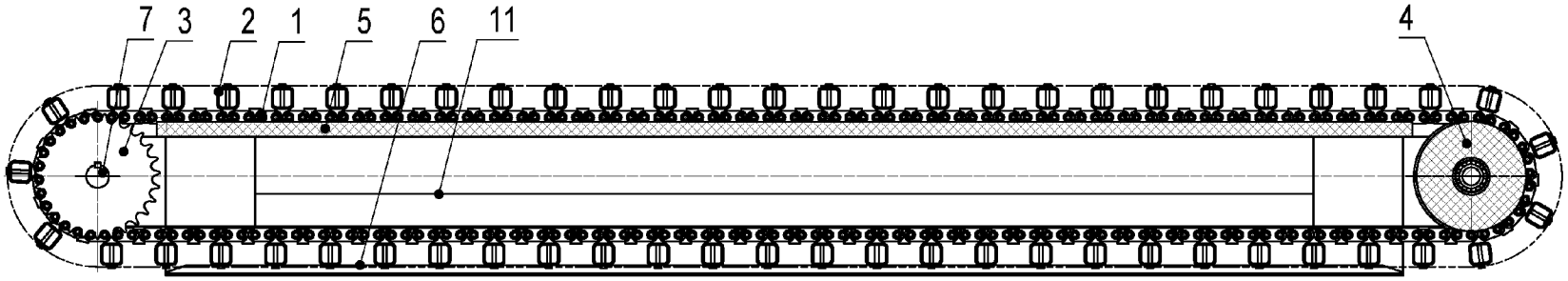
FIG. 2 is a sectional view of the structure of a carrier chain in accordance with the teachings of this disclosure.

The conveyor assembly 10 is further illustrated by reference to FIG. 2. Referring to FIG. 2, a sectional view of the structure of the conveyor assembly 10 is shown. Each conveyor assembly 10 includes a pair of driving sprockets 3 meshing with the two chains 1, a pair of sliding rails 5, a pair of sliding pallets, and a drive sprocket axle 7. The two driving sprockets 3 are operatively coupled to the drive sprocket axle 7 using, for example, bearings and bolts. When the device 100 is in operation, the pair of driving sprockets 3 is in coaxial synchronous rotation. On its opposite ends, the conveyor assembly 10 includes two tension pulleys 4 for tensioning the chains 1.

When in rotational motion, the four upper portions of the four chains 1 support the weight of the vehicle being carried by the conveyor assemblies 10, while the lower portions of the chains 1 do not support the weight of the vehicle. The upper portion of each chain 1 slides on the sliding rail 5 when in operation. The sliding rails 5 are affixed to the frame 11. In one implementation the sliding rails 5 are made of, for example, non-metallic polymer materials. The lower portions of the four chains 1 slide on the four respective sliding pallets 6. The sliding pallets 6 can be made of, for example, non-metallic polymer materials. The sliding pallets 6 are affixed to the frame 11, and support the weight of the lower portions of the chains 1 and the beams 2. In other words, the sliding pallets 6 prevent sagging of the chains 1 and the beams 2.

Through the transmission shaft 8, the four drive sprocket axles 7 are connected and rotate synchronously. Accordingly, the pair of the conveyor assemblies 10 operates in synchronous motion to transport the vehicle. The transmission shaft 8 is operatively coupled to a power transmission gear 9. The power transmission gear 9 transmits power from parking equipment's listing device to the four driving sprockets 3 of the device 100. The driving sprockets 3 then cause the two conveyor assemblies 10 move in circulating motion and transport the vehicle resting on the conveyor assemblies 10 to a desired parking location.

The vehicle conveying device 100 transports vehicles in different modes. In a first mode, a vehicle is in parallel to the chains 1. In this mode, the two left side tires and the two right side tires of the vehicle rest on the two conveyor assemblies 10 respectively. In the other mode, the two front tires and the two rear tires of the vehicle rest on the two conveyor assemblies 10 respectively. Depending on the transportation mode, the distance between the conveyor assemblies 10 can be adjusted. For example, in the first mode, the distance between the vehicle's two front (or rear) tires matches or is close to the distance between the two longitudinal centers of two corresponding crossbeams 2. As an additional example, in the second mode, the vehicle's wheelbase matches or is close to the distance between the two longitudinal centers of two corresponding crossbeams 2. The length of the beams 2 is sufficient to support vehicles of different tire widths.

Figure 3:
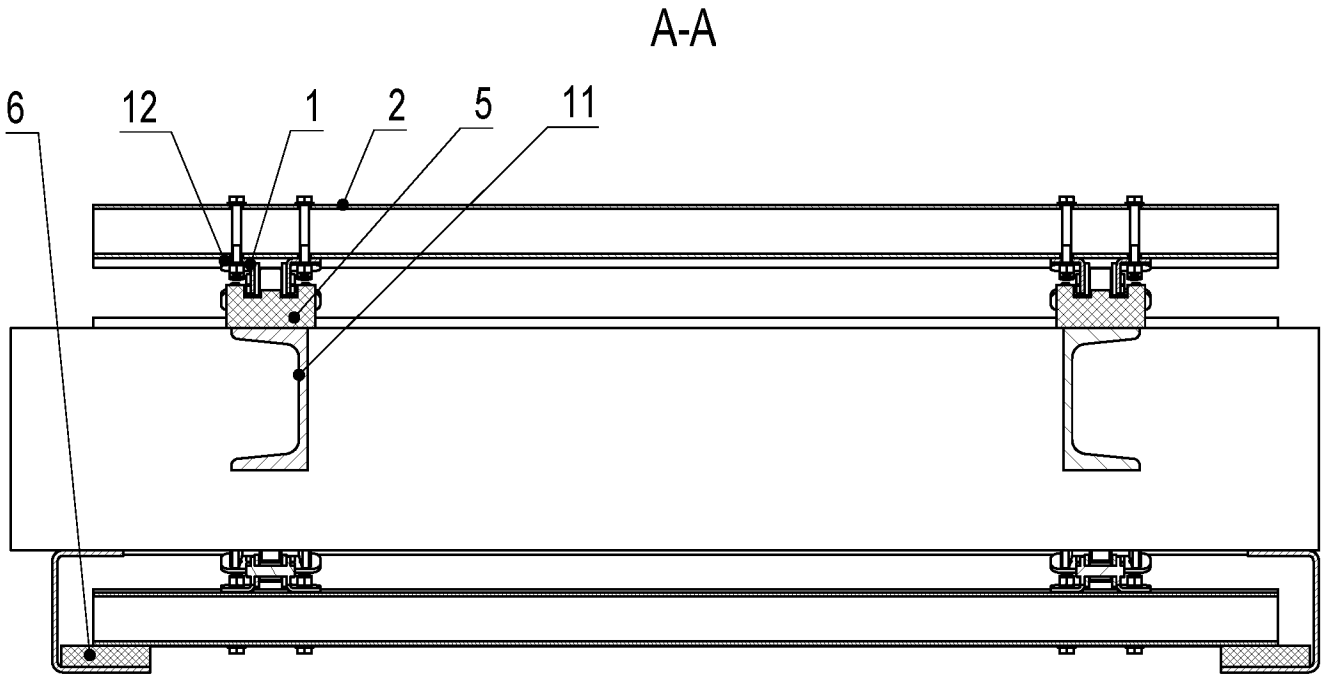
FIG. 3 is a cutaway view of a chain type vehicle conveying device for a stereo garage in accordance with the teachings of this disclosure.
Figure 4:
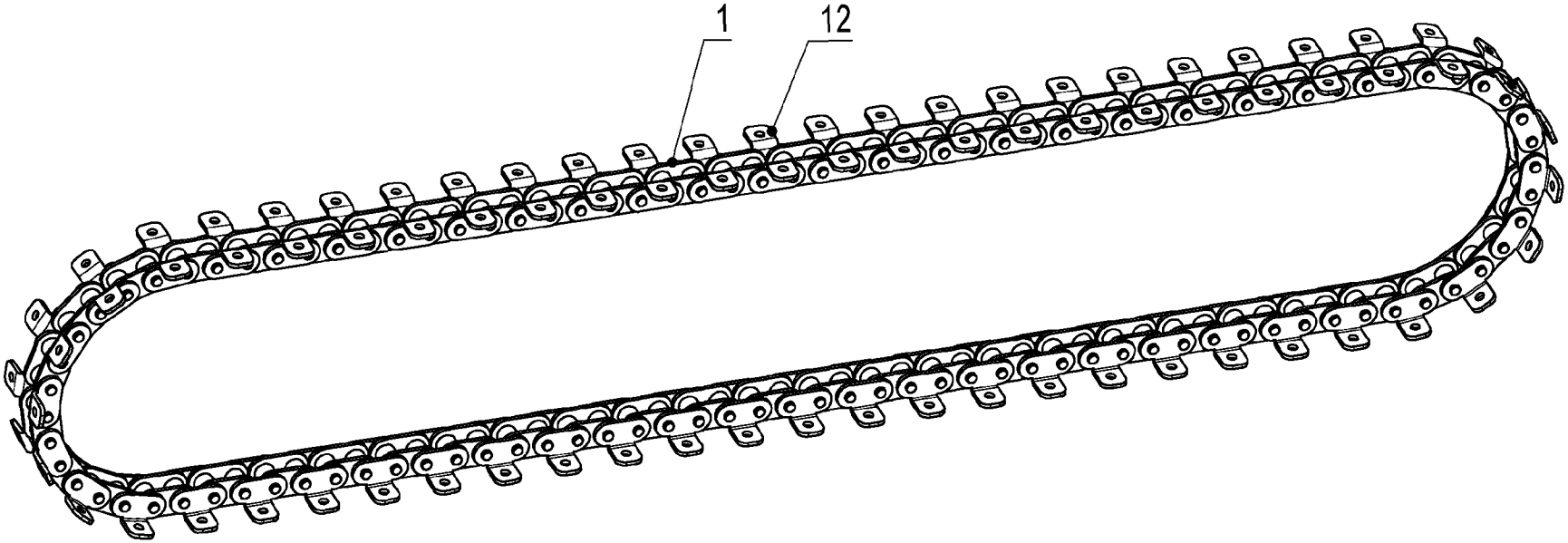
FIG. 4 is a front perspective view of a chain with an attached plate in accordance with the teachings of this disclosure.

The vehicle conveying device 100 is further illustrated by reference to FIG. 3. FIG. 3 shows a cutaway view of the chain type vehicle conveying device 100 along the A-A direction that is shown in FIG. 1. The chains 1 with attached plates are further illustrated by reference to FIG. 4.

Obviously, many additional modifications and variations of the present disclosure are possible in light of the above teachings. Thus, it is to be understood that, within the scope of the appended claims, the disclosure may be practiced otherwise than is specifically described above without departing from the true spirit and scope of the present invention.

The foregoing description of the disclosure has been presented for purposes of illustration and description, and is not intended to be exhaustive or to limit the disclosure to the precise form disclosed. The description was selected to best explain the principles of the present teachings and practical application of these principles to enable others skilled in the art to best utilize the disclosure in various embodiments and various modifications as are suited to the particular use contemplated. It should be recognized that the words "a" or "an" are intended to include both the singular and the plural. Conversely, any reference to plural elements shall, where appropriate, include the singular.

It is intended that the scope of the disclosure not be limited by the specification, but be defined by the claims set forth below. In addition, although narrow claims may be presented below, it should be recognized that the scope of this invention is much broader than presented by the claim (s). It is intended that broader claims will be submitted in one or more applications that claim the benefit of priority from this application. Insofar as the description above and the accompanying drawings disclose additional subject matter that is not within the scope of the claim or claims below, the additional inventions are not dedicated to the public and the right to file one or more applications to claim such additional inventions is reserved.

What is claimed is:

1. A chain type vehicle conveying device for a stereo garage comprising:

i) two synchronously circulating conveyor assemblies mounted to a frame, each of said two conveyor assemblies having two chains with attached plates and a set of crossbeams mounted to said two chains, each said chain having an upper portion supporting a weight of a vehicle and a lower portion;

ii) four sliding rails mounted to said frame, wherein each said upper portion slides on a corresponding sliding rail of said four sliding rails;

iii) four sliding pallets mounted to said frame, wherein each said lower portion slides on a corresponding sliding pallet of said four sliding pallets; and iv) four driving sprockets and four tension pulleys, said four driving sprockets mounted to a transmission shaft, said four driving sprockets meshing with said respective chains.

2. The chain type vehicle conveying device of claim 1 further comprising a power transmission gear mounted to said transmission shaft, wherein said power transmission gear transmits power to said four driving sprockets, wherein said four driving sprockets are in coaxial synchronous motion.

3. The chain type vehicle conveying device of claim 1, wherein a spacing between two consecutive parallel crossbeams is not more than a third of a width of a tire of said vehicle.

4. The chain type vehicle conveying device of claim 1, wherein said four sliding rails and said sliding pallets are made of a polymer materials.

5. The chain type vehicle conveying device of claim 1, wherein said vehicle rests on said a set of crossbeams and moves by friction between a tire of said vehicle and said a set of crossbeams.

* * * * *